US009522452B2

(12) United States Patent
Rattunde

(10) Patent No.: US 9,522,452 B2
(45) Date of Patent: Dec. 20, 2016

(54) BRUSH-TYPE DEBURRING MACHINE

(75) Inventor: Ulrich Rattunde, Bentwisch (DE)

(73) Assignee: RATTUNDE & CO. GmbH, Ludwigslust (DE)

( * ) Notice: Subject to any disclaimer, the term of this patent is extended or adjusted under 35 U.S.C. 154(b) by 775 days.

(21) Appl. No.: 13/825,315

(22) PCT Filed: Sep. 15, 2011

(86) PCT No.: PCT/EP2011/066028

§ 371 (c)(1),
(2), (4) Date: Jun. 1, 2013

(87) PCT Pub. No.: WO2012/038323

PCT Pub. Date: Mar. 29, 2012

(65) Prior Publication Data

US 2013/0260652 A1 Oct. 3, 2013

(30) Foreign Application Priority Data

Sep. 24, 2010 (DE) ..... 10 2010 046 392

(51) Int. Cl.
*B21C 37/30* (2006.01)
*B24B 9/00* (2006.01)

(52) U.S. Cl.
CPC ..... *B24B 9/00* (2013.01); *B21C 37/30* (2013.01); *B24B 9/002* (2013.01); *B24B 9/007* (2013.01)

(58) Field of Classification Search
CPC ..... B24B 37/24
USPC ..... 451/49, 59, 51, 194
See application file for complete search history.

(56) References Cited

U.S. PATENT DOCUMENTS

| | | | |
|---|---|---|---|
| 1,919,639 | A | 7/1933 | Albert |
| 1,974,696 | A | 9/1934 | Swanson |
| 2,341,825 | A | 2/1944 | Spicacci |
| 2,358,854 | A | 9/1944 | Elvin |
| 2,386,742 | A | 10/1945 | MacNeill |
| 2,795,090 | A | 6/1957 | Sterna |
| 2,805,524 | A | 9/1957 | Silven |

(Continued)

FOREIGN PATENT DOCUMENTS

| | | |
|---|---|---|
| DE | 11 54 698 B | 9/1963 |
| DE | 21 52 229 A1 | 4/1973 |

(Continued)

*Primary Examiner* — Monica Carter
*Assistant Examiner* — Lauren Beronja
(74) *Attorney, Agent, or Firm* — Lazaris IP

(57) ABSTRACT

The invention concerns a brush-type deburring machine for simultaneously deburring of an elongate profile section arranged in the longitudinal direction during conveying in a conveying direction with two rows, extending respectively in the conveying direction, of conveying discs arranged offset with respect to each other and having apertures arranged along the periphery thereof for receiving the opposite ends, which are arranged offset with respect to one another, in order to permit a transfer of the elongate profile sections in the conveying direction by rotation of the conveying discs, and the two rows are at a distance adjustable in the longitudinal direction from a minimum distance of less than 80 mm from each other, and with two rotatable brush rollers which are orientated in each case in the conveying direction along one of the two rows (and which are intended for the deburring of the two opposite ends of the conveyed elongate profile sections.

7 Claims, 4 Drawing Sheets

(56) References Cited

U.S. PATENT DOCUMENTS

| | | | | |
|---|---|---|---|---|
| 3,045,268 | A | 7/1962 | Coan | |
| 3,063,078 | A | 11/1962 | Strohmeier | |
| 3,112,851 | A | 12/1963 | Collins | |
| 3,311,940 | A | 4/1967 | Spittler | |
| 3,501,870 | A | 3/1970 | Bottomley | |
| 4,860,499 | A | 8/1989 | Dinger et al. | |
| 6,206,763 | B1 * | 3/2001 | Mackall ..... | B24B 9/007 198/626.5 |
| 6,638,150 | B2 * | 10/2003 | Walczak ..... | B23D 47/042 198/468.01 |

FOREIGN PATENT DOCUMENTS

| | | | |
|---|---|---|---|
| DE | 75 16 108 | U | 9/1975 |
| DE | 80 16 246 | U1 | 9/1980 |
| DE | 34 30 065 | A1 | 2/1986 |
| DE | 195 16 607 | C1 | 5/1996 |
| DE | 10 2010 050 317.7 | | 11/2010 |
| GB | 1153896 | A | 5/1969 |
| WO | WO 2012059487 | A1 | 5/2012 |

* cited by examiner

BRUSH-TYPE DEBURRING MACHINE

CROSS REFERENCE TO RELATED PATENT APPLICATIONS

This patent application is filed herewith for the U.S. National Stage under 35 U.S.C. §371 and claims priority to PCT application PCT/EP2011/066028, with an international filing date of Sep. 15, 2011. The contents of this application are incorporated in their entirety herein.

STATEMENT REGARDING FEDERALLY-SPONSORED RESEARCH OR DEVELOPMENT

Not applicable.

TECHNICAL FIELD

The invention relates to a brush-type deburring machine for simultaneously deburring opposite ends of an elongate profile formed in the longitudinal direction, during conveying in a conveying direction.

BACKGROUND OF THE INVENTION

Brush-type deburring machines are already known in the prior art. As a rule, brush-type deburring machines are not used independently, but frequently in combination with pipe-cutting machines which cut pipe sections to length from a metal pipe at a high clock time. The section cut to length is then further processed. The further processing can take place in various successive method steps, and in particular pipe ends can be beveled and/or washed and/or deburred flat. During their conveying by means of conveying discs, ends and cut faces of the metal pipes are freed by the brush-type deburring machine from sharp edges and from pipe cuttings remaining over in the cutting process. A brush-type deburring machine of this type is known from U.S. Pat. No. 3,045,268.

A brush-type deburring machine is known from DE 195 16 607 C1, with laterally rotating roller brushes past which entrainment means run in each case which are arranged in pairs opposite one another and convey a pipe past the roller brushes in each case, in order to deburr the ends of the pipes.

A brush-type deburring machine is disclosed in DE 34 30 065 A1, which likewise discloses two laterally rotating brushes, in which the pipes are conveyed by means of entrainment means in the longitudinal direction of the roller brushes and are deburred in this case by the rotating roller brushes. These brush-type deburring machines are suitable for deburring pipes from a length of approximately 90 mm. They are not suitable for pipe sections of shorter length.

BRIEF SUMMARY OF THE INVENTION

The object of the invention is therefore to make available a brush-type deburring machine by which elongate profile portions of shorter length can also be deburred.

The object is attained by a brush-type deburring machine specified in the introduction having the features of claim 1.

The brush-type deburring machine according to the invention is suitable, in particular, for deburring sections of an elongate profile, in particular of metal, which have been cut to length. Elongate profiles are understood in this case to mean hollow profiles, in particular pipes, but also solid profiles, profiles angled in cross-section etc. In this case the elongate profile sections are cut to length from the elongate profile with the aid of a cutting machine or sawing machine arranged upstream of the brush-type deburring machine. The brush-type deburring machine according to the invention is preferably a component part of a sawing processing centre in which the elongate profile sections are cut to length at a high clock time, i.e. of up to 230 sections in four-fold cutting per minute, and also have to be deburred at a similarly high piece rate per minute in order to be able to ensure a flowing processing sequence.

To this end, the elongate profile sections cut to length are conveyed further in the conveying direction by means of two rows of conveying discs extending adjacent to each other in the conveying direction by an advance produced by the rotation of the conveying discs. Each of the rows has in each case at least two conveying discs, at least two being understood here and hereinafter as being the numbers three, four and any higher natural number. The conveying discs are arranged offset from one another along each of the two rows and are arranged overlapping one another in the conveying direction. They have apertures along their periphery. The apertures allow conveying in the conveying direction by the transfer of the elongate profile sections from one conveying disc to the conveying disc directly adjacent in the conveying direction. In this case opposite ends of the elongate profile section sweep past brush-type rollers which are orientated in the conveying direction and which are rotatable about the axis of rotation thereof preferably orientated parallel to the conveying direction. The actual deburring of the two opposite ends of the elongate profile section is carried out by the brush rollers which rotate during the operation and which are in contact with one end of the elongate profile in each case.

According to the invention elongate profile sections from a length of less than 80 mm, preferably less than 30 mm, can be deburred by the brush-type deburring machine. Two this end, the two rows of conveying discs are displaceable towards each other to a distance of less than 30 mm. In order to achieve this aim, the conveying discs are designed with a thickness in each case of at most from 1 to 3 mm, preferably of at most 1 mm, which are arranged offset from one another in each of the two rows so that the total thickness of the mutually overlapping conveying discs amounts to less than 6 mm, preferably less than 2 mm.

In a preferred further development of the invention the brush-type deburring machine according to the invention has two frame arms which extend in the conveying direction and on which a row of rotatable conveying discs is arranged in each case. It is preferable for the first two conveying discs in the conveying direction to be driven by a servo motor in each case. The second, fourth, sixth conveying disc and so forth is coupled to the first conveying disc by way of a gear mechanism, whereas the third, fifth conveying disc and so forth is coupled to the second conveying disc by way of another gear mechanism. The conveying discs in mutual alignment in a precise manner in the conveying direction are therefore advantageously coupled to one another. The two sets of alignment are arranged offset and adjacent to each other. It is naturally also possible to drive any other conveying discs of the respective set of alignment instead of the first and second conveying discs.

One brush roller is provided on the outside along each of the frame arms. The two frame arms are made concave on one outer wall in each case, namely in such a way that one brush roller associated with the respective frame arm is capable of being brought closer—with respect to the straight formation of the wall—to the elongate profile sections conveyed in the conveying direction. It is advantageous for the outer wall of the frame arm to be made concave over the entire length of the respective brush roller.

Each of the conveying discs has in each case an inner face towards the opposite row of conveying discs and an outer face towards the frame. In this case "inner" and "outer" are thus to be understood consistently in this sense.

In a further embodiment of the invention it is preferable for each of the conveying discs to be arranged in a rotationally fixed manner on a turntable with one anti-rotation means in each case. The anti-rotation means preferably has a structural height of at most 4 mm, preferably at most 2 mm, on the inside of the inner face of the respective conveying disc.

The anti-rotation means has a turntable, an opening in the conveying disc and a short cylinder as the essential components. The opening in a cross-section extending in the face of the conveying disc is not made rotationally symmetrical. An equal opening can be provided in each of the conveying discs. The cylinder has a cross-section of uniform shape, and it is capable of being passed through the opening in a positively locking manner. An inner end of the short cylinder is designed in the form of a collar which engages behind the opening in the conveying disc and draws it towards a turntable for fastening purposes, in which case the turntable, which is arranged in a rotatable manner on the frame arm, has a central aperture which is likewise adapted in cross-section to the opening cross-section—not rotationally symmetrical—and is provided for receiving the end of the cylinder on the outside in a positively locking manner. A thread, into which a screw can be screwed and which fastens the cylinder to the turntable whilst clamping the conveying disc, is provided in the cylinder centrally on the outside.

On account of the low structural height of the cylinder collar and the slight thickness of the conveying disc and the concave design of one of the outer regions of the conveying frame, a brush-type deburring machine is capable of being produced which makes it possible to deburr sections with a length from 30 mm.

BRIEF DESCRIPTION OF THE SEVERAL VIEWS OF THE DRAWINGS

The invention is described in four Figures with reference to one embodiment. In the Figures.

DETAILED DESCRIPTION OF THE INVENTION

Figure 1:
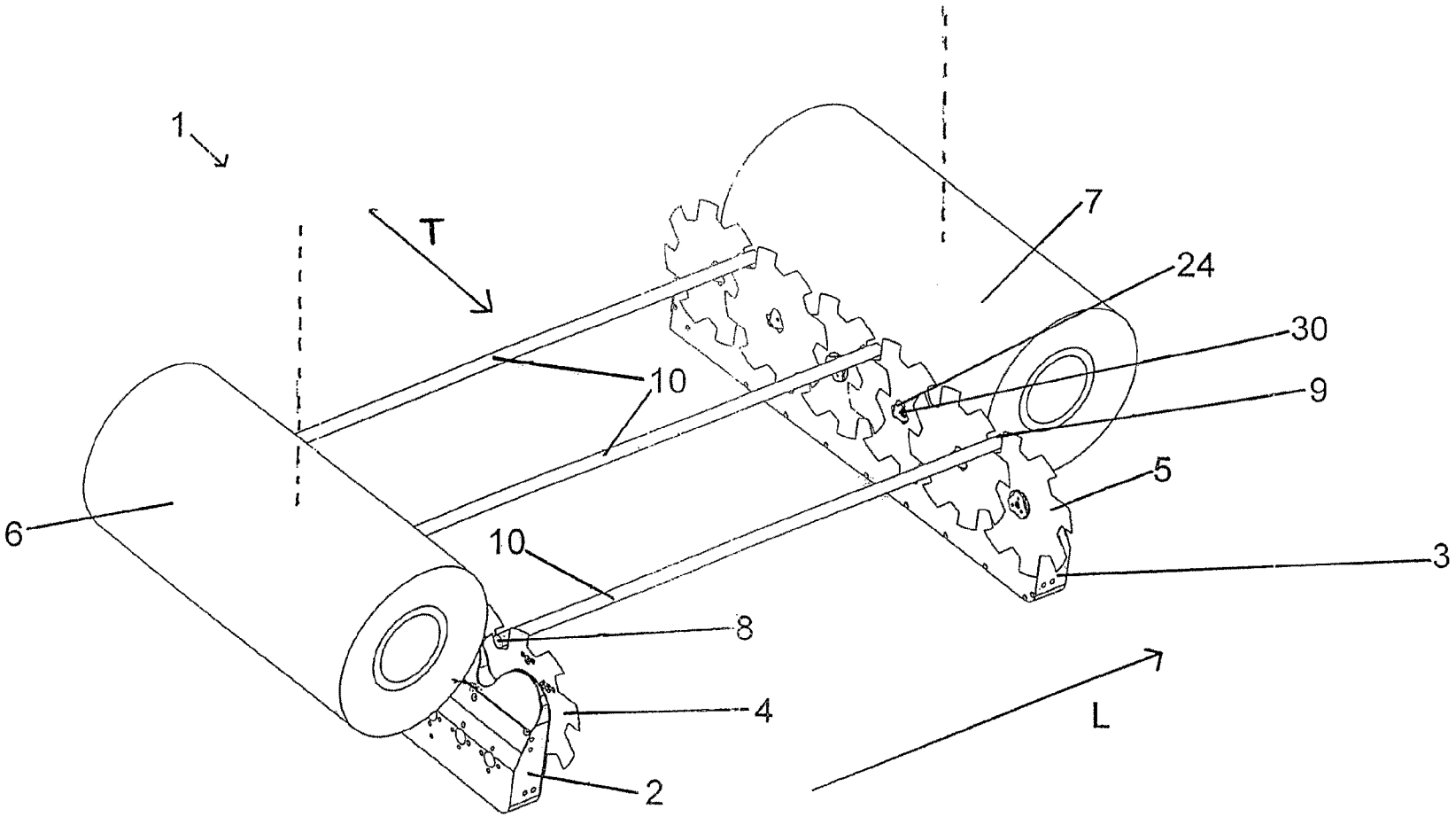
FIG. 1 is a perspective view of a brush-type deburring machine according to the invention.

The brush-type deburring machine 1 illustrated diagrammatically in FIG. 1 has a first and a second frame arm 2, 3 which are orientated parallel to each other and which are orientated along a conveying direction T. A first row and a second row of conveying discs arranged offset one in the other are provided on the inner side of each of the two frame arms 2, 3. Each of the conveying discs of the two rows 4, 5 is arranged on the respective frame arm 2, 3 in a rotatable manner. On the outside a first brush roller 6 is arranged along the first frame arm 2 in a rotatable manner and a second brush roller 7 along the second frame arm 3, orientated in each case in the conveying direction T. The conveying discs are driven jointly and make it possible to advance sawn-off elongate profile sections 10 in the conveying direction T. In this case the elongate profile sections 10 are orientated at a right angle to the conveying direction T in the longitudinal direction L in each case. The elongate profile sections 10 can be metal profiles, in particular pipe sections, preferably metal pipe sections. The latter are illustrated in FIG. 1.

The two frame arms 2, 3 are adjustable in the longitudinal direction L at a distance from each other. The brush rollers 6, 7 are driven independently of the conveying discs of the rows 4, 5. The brush rollers 6, 7 rotate during the conveying of the elongate profile sections 10 in the conveying direction T. In this case the first brush roller 6 deburrs a first outer end 8 and the second brush roller 7 deburrs a second outer end 9 of the elongate pro-file section.

The brush-type deburring machine 1 is shown isolated here, but as a rule it is part of a pipe-cutting machine in which elongate profile sections 10 are subjected in one or more stages to a further treatment. As well as the beveling and washing, the deburring of the elongate profile sections 10 also belongs to the method stages of further treatment. The elongate profile sections 10 are portions of a long metal pipe cut to length. As a result of cutting the sections, sharp burrs and residues of metallic chips occur on the cut faces.

The distance of the two frame arms 2, 3 from each other is adjustable together with the conveying discs of the rows 4, 5 and also the brush rollers 6, 7 associated with the two frame arms 2, 3. According to the invention the distance is capable of being reduced to the extent that elongate profile sections 10 of a length of from 30 mm are capable of being conveyed in a reliable manner through the brush-type deburring machine in the conveying direction T with the aid of the two rows of conveying discs 4, 5 arranged parallel to each other and the two ends 8, 9 thereof in each case can nevertheless be accurately deburred. Each individual one of the conveying discs of the two rows 4, 5 has along the respective periphery thereof apertures which make it possible to convey the elongate profile sections 10 by transferring them from one conveying disc to the next one in the conveying direction and to deburr the ends 8, 9 in this case over the entire length of the conveying direction T. The apertures of conveying discs following one after the other in the conveying direction T are adapted to one another in size and arrangement for the transfer of the elongate profile sections 10.

Figure 2:
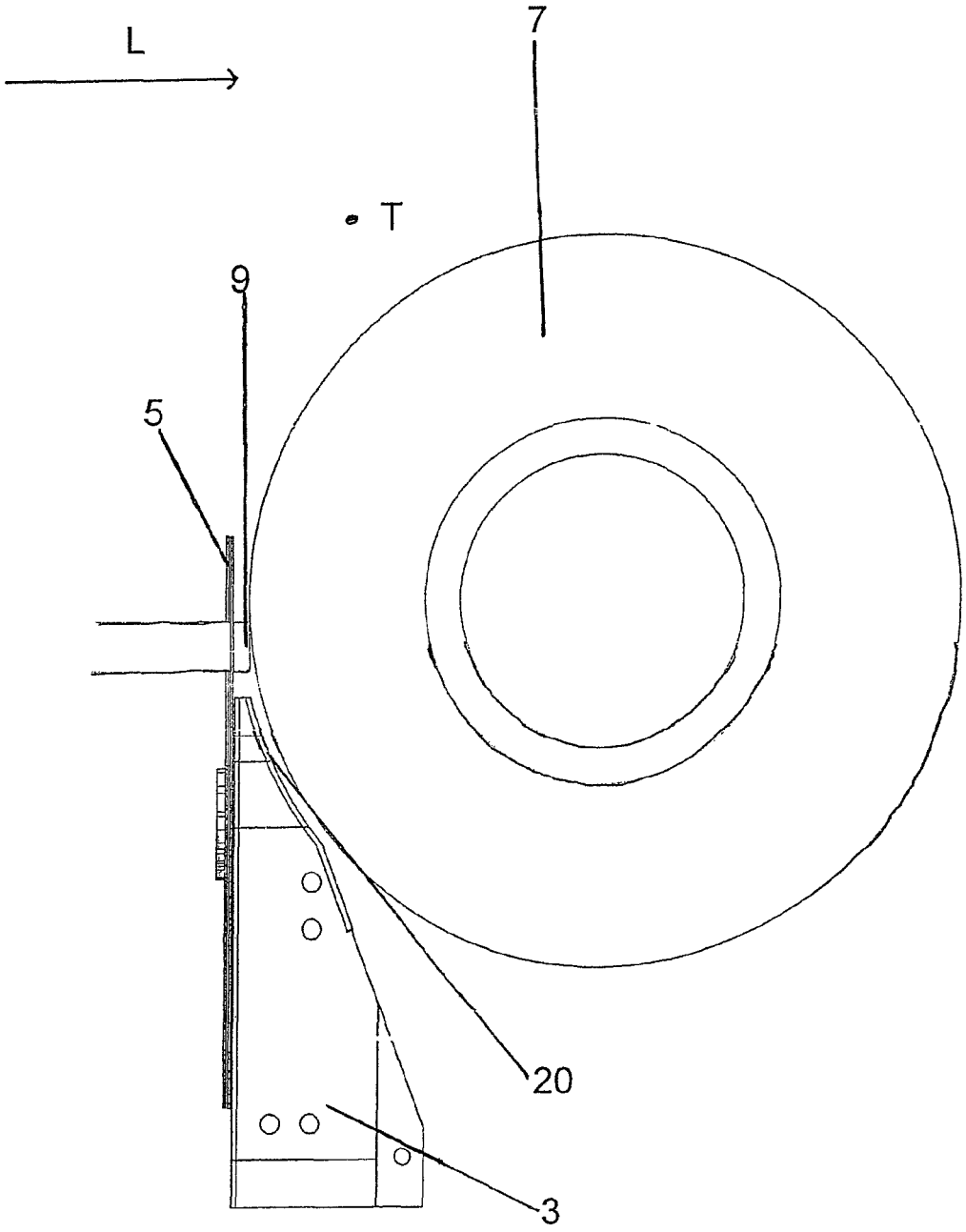
FIG. 2 is a plan view of a frame arm in FIG. 1.
Figure 3:
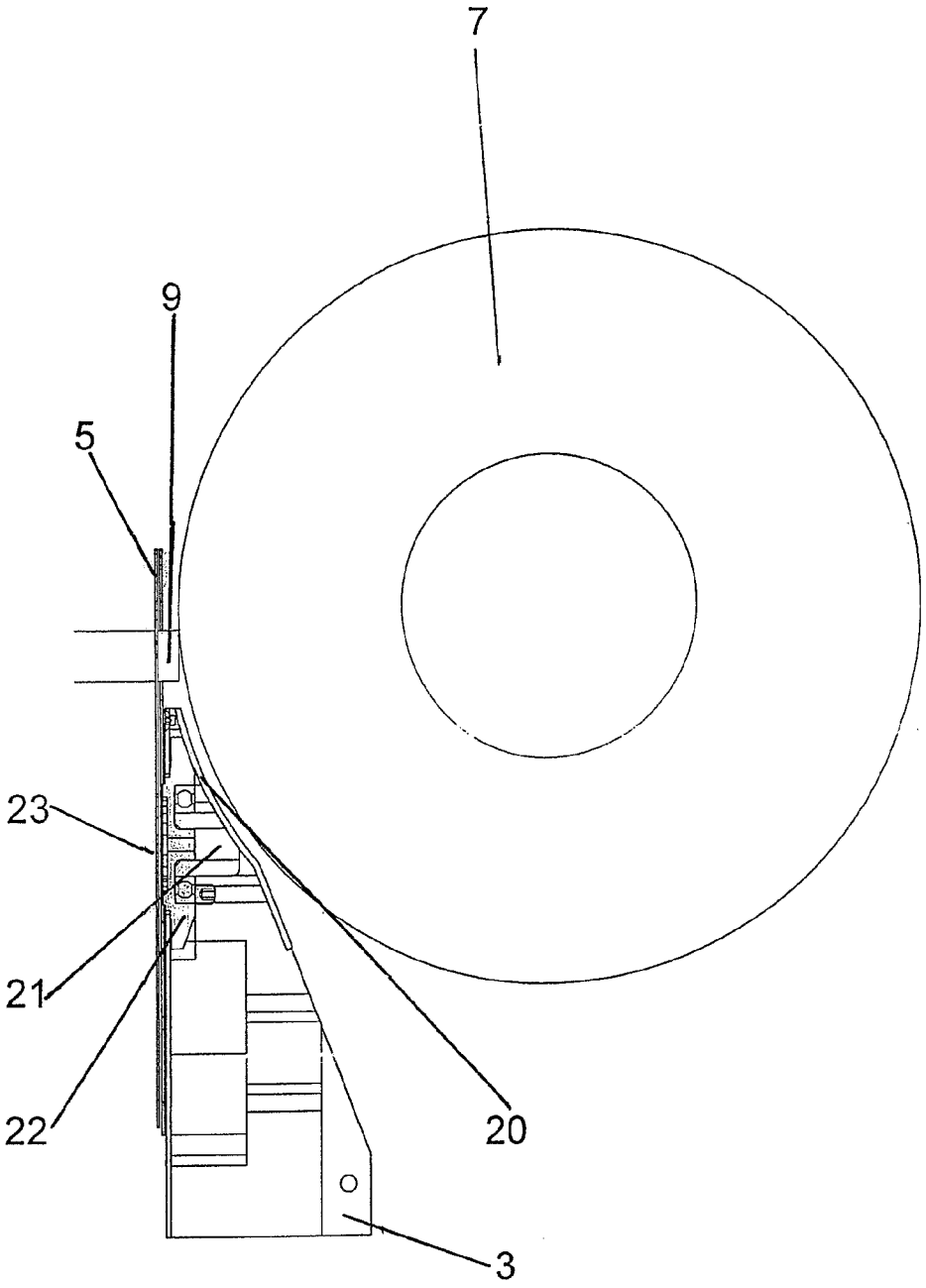
FIG. 3 is a section view along the line III/III in FIG. 1.

FIG. 2 shows the second frame arm 3, on the right in FIG. 1, in a plan view, and FIG. 3 shows the same frame arm 3 in a sectional view. As shown in FIGS. 2 and 3, the outer wall of the frame arm 3 is made concave in a region 20 towards the brush roller 7 and facing away from the bottom, in such a way that along the entire length of the second brush roller 7 in the conveying direction T the concave region 20 is adapted to the curvature of an outer circular periphery of the brush roller 7 and is made concave towards the inside. As a result, as shown in FIG. 2, the brush roller 7 can be brought a little closer—with respect to a straight wall—to the conveyed elongate profile section 10. It is thus possible for elongate profile sections 10 of shorter length to be conveyed, since with the same deburring quality the second end 9 projecting outwards beyond the second row of conveying discs 5 has to be shorter than conventional ends so as still to come into contact with the second brush roller 7. As well as the second frame arm 3 of the brush roller 7, FIG. 2 shows in plan view the second of a row of conveying discs 5 which are arranged offset from one another in the conveying direction T and overlapping one another.

FIG. 3 shows the second frame arm 3 in a cross-section, in which a ball bearing 21 for one of the conveying discs 23 may be seen. One conveying disc 23 is mounted in a rotationally fixed manner on a turntable 22 which is arranged in the second frame arm 3 so as to be rotatable by means of the ball bearing 21.

FIGS. 2 and 3 show the thin design of one conveying disc 23 in the longitudinal direction L, which amounts to approximately one millimeter or less.

The anti-rotation means 30 shown to some extent in FIG. 1 displays a short cylinder 24 which is attached centrally to each of the conveying discs 23 on the inside and by which the respective conveying disc 23 is fastened in a rotatable manner to the second frame arm 3. The anti-rotation means 30 is shown in detail in FIG. 4.

Figure 4:
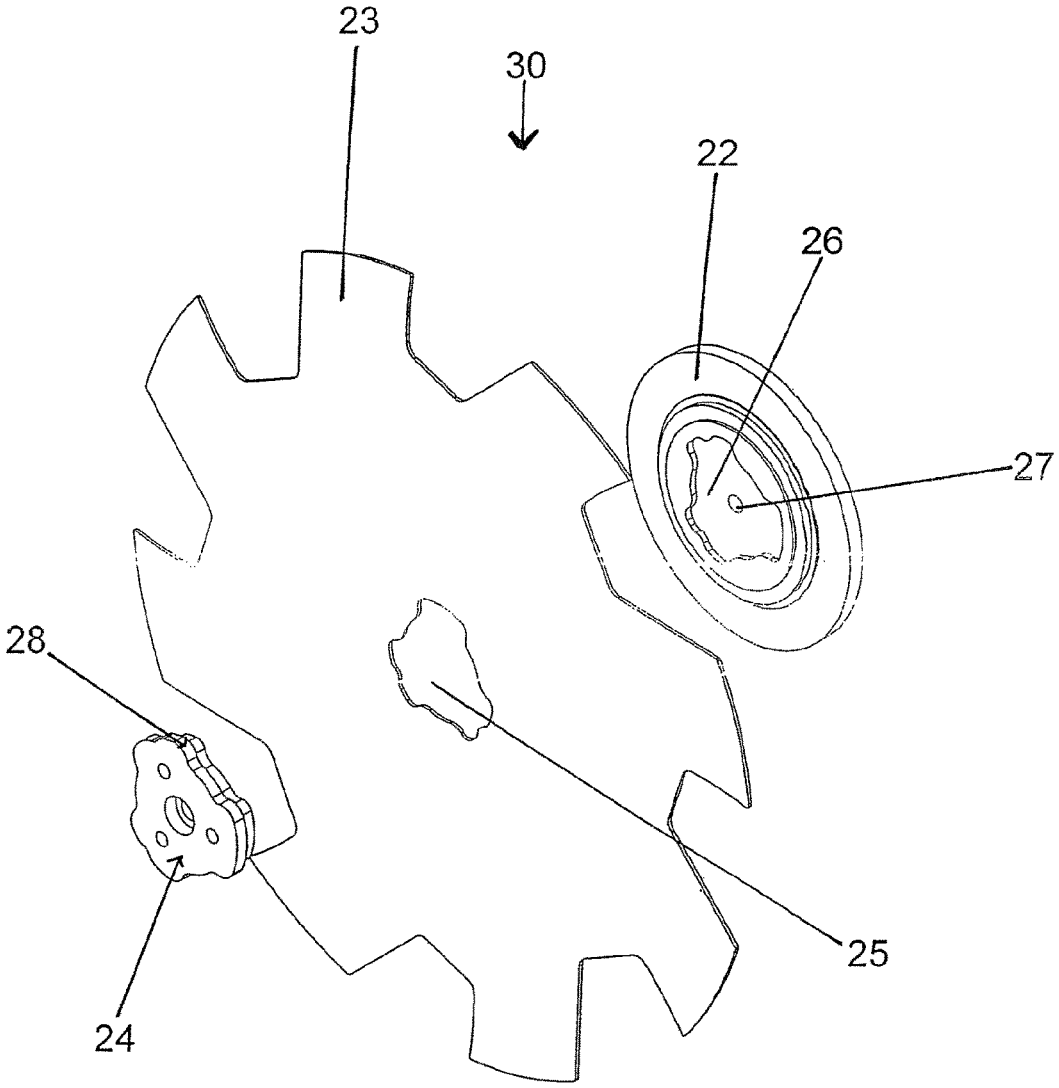
FIG. 4 is an exploded illustration of the anti-rotation means in FIG. 1.

FIG. 4 shows the anti-rotation means 30 with one conveying disc 23 in an exploded illustration. The turntable 22 is arranged in a rotatable manner on the second frame arm 3 by means of a ball bearing 21. One conveying disc 23 with a central opening 25 not rotationally symmetrical is capable of being set on the turntable 22, the turntable 22 having an aperture 26 congruent with the cross-section of the opening 25 of the conveying disc 23. The short cylinder 24 likewise made congruent in cross-section with the opening 25 and the aperture 26 is capable of being inserted through the opening 25 and of being fixed in a positively locking manner in the aperture 26 of the turntable 22.

The cylinder 24 can be screwed firmly on the inside by means of a screw (not shown) in a thread 27 arranged centrally in the turntable 22. The conveying disc 23 provided between an internal collar 28 of the cylinder and the turntable 22 is fastened in a manner prevented from rotating with respect to the turntable 22 in this way. The cylinder collar 28 projects on the inside from the conveying disc 23 by 1 to 3 mm depending upon the design. On account of the short design of the mounted anti-rotation means 30, on the inside of the conveying disc 23, the two mutually opposite frame arms 2, 3 can be displaced quite close to each other. As a whole, elongate profile sections 10 from a length of L=30 mm can thus be deburred.

The brush-type deburring machine 1 is suitable for use with a pipe-cutting machine which saws pipe sections at a high clock time from a completely metal tube, in which clock rates of 60 sections per minute are capable of being achieved, which are received by the brush-type deburring machine 1 after the sawing and can be deburred at a correspondingly high clock time.

LIST OF REFERENCES

1 brush-type deburring machine
2 first frame arm
3 second frame arm
4 first row of conveying discs
5 second row of conveying discs
6 first brush roller
7 second brush roller
8 first outer end of an elongate profile
9 second outer end of an elongate profile
10 sawn-off elongate profile sections
20 concave region
21 ball bearing
22 turntable
23 conveying disc
24 short cylinder
25 opening
26 aperture
27 thread
28 cylinder collar
30 anti-rotation means
L longitudinal direction
T conveying direction

What is claimed is:

1. A brush-type deburring machine for simultaneously deburring opposite ends of an elongate profile section arranged in the longitudinal direction, during conveying in a conveying direction, with two rows—extending in each case in the conveying direction—of conveying discs arranged offset with respect to one another in each case and having apertures arranged in each case along the periphery thereof for receiving the ends which are arranged offset with respect to one another, in order to permit a transfer of the elongate profile sections in the conveying direction by rotation of the conveying discs and transferring the elongate profiles from one conveying disc to a next one in the conveying direction and the apertures are adapted to one another in size and arrangement for the transfer, and the two rows are at a distance adjustable in the longitudinal direction from a minimum distance of less than 80 mm from each other, and with two rotatable brush rollers which are orientated in each case in the conveying direction along one of the two rows and which are intended for the deburring of the two ends of the conveyed elongate profile sections and each conveying disc is mounted in a rotationally fixed manner on a corresponding turntable which is arranged in a frame arm.

2. A brush-type deburring machine according to claim 1, characterized in that the two rows are at an adjustable distance from each other from a minimum distance of between 30 to 60 mm in the longitudinal direction.

3. A brush-type deburring machine according to claim 1, characterized in that the two rows are at an adjustable distance from each other from a minimum distance of less than 35 mm in the longitudinal direction.

4. A brush-type deburring machine according to claim 1, characterized in that each of the rows is provided with conveying discs arranged off-set from one another and having a maximum thickness of from 1 to 3 mm in each case.

5. A brush-type deburring machine according to claim 1, characterized in that the conveying discs of each of the rows opposite each other are arranged on one frame arm in each case and have an inner face towards the opposite row and an outer face towards the associated frame arm in each case, and each of the conveying discs is capable of being fastened to the frame arm by means of an anti-rotation means projecting at most 4 mm beyond the respective inner face.

6. A brush-type deburring machine according to claim 5, characterized in that each anti-rotation means has an opening—not rotationally symmetrical in a cross-section extending in the face of the conveying disc—in the conveying disc, into which a cylinder, which is adapted to the cross-section of the opening and the inner end of which projects at most 4 mm from the inner face, is capable of being inserted.

7. A brush-type deburring machine according to claim 5, characterized in that an outer wall of the frame arm is made concave in a region adjacent to the brush rollers in a cross-section in the longitudinal direction.

* * * * *